United States Patent [19]

Russell et al.

[11] Patent Number: 4,847,859

[45] Date of Patent: Jul. 11, 1989

[54] DEVICE AND METHOD FOR COOLING A HIGH TEMPERATURE FURNACE

[75] Inventors: Patrick M. Russell, Freeland; Jose Porchia, Midland; Roger K. Pihlaja, Sanford, all of Mich.

[73] Assignee: The Dow Chemical Company, Midland, Mich.

[21] Appl. No.: 248,655

[22] Filed: Sep. 26, 1988

[51] Int. Cl.[4] ..... F27D 1/12

[52] U.S. Cl. ..... 373/113; 165/96; 165/86

[58] Field of Search ..... 373/74, 76, 113, 137, 373/136, 158, 165; 165/96, 86; 432/237, 238

[56] References Cited

U.S. PATENT DOCUMENTS 3,558,122 1/1971 Jaross ..... 165/96

4,734,127 3/1988 Iuchi ..... 373/113

*Primary Examiner*—Roy N. Envall, Jr.

*Attorney, Agent, or Firm*—V. Dean Clausen

[57] ABSTRACT

The invention is a device and method for cooling a high temperature furnace. A typical high temperature furnace will include a hot zone that is insulated with carbon-based materials, such as lamp-black. The cooling device is a probe consisting of two elongate tubular members. The smaller diameter member fits lengthwise inside the larger member, such that an annulus is defined within the probe. A tapered metal tip at the lower end of the probe is positioned above a frangible disk, and the disk fits over a guide tube that extends into the insulation section. In operation, the probe is shoved downwardly through the frangible disk into the guide tube, to position the tip near the hot zone of the furnace. An inert gas is then passed through the inside member of the probe, and exhausted through the annulus, to dissipate the furnace heat.

8 Claims, 2 Drawing Sheets

DEVICE AND METHOD FOR COOLING A HIGH TEMPERATURE FURNACE

BACKGROUND OF THE INVENTION

The invention relates to a means for cooling a high temperature furnace. In particular, the invention is directed to a probe device useful for cooling furnaces that operate at extremely high temperatures.

Boron carbide and titanium diboride are examples of materials used in high temperature applications, such as refractories, nuclear reactor control rods, high temperature electrical conductors, etc. Materials of this type are made in electric furnaces that operate at temperatures above 1000° C. The furnaces are usually insulated with carbon-based materials, such as lampblack, and they are filled with an inert gas, such as argon.

The severe temperature environment inside the furnace prevents use of metals or metal alloys as materials of construction for various furnace components, such as the heater boards, the roof and floor of the hot zone, the product boats, etc. Under these conditions metals suffer from creep, oxidation, and loss of strength. The common ceramic materials are also unsuitable for this purpose, in that they have very poor thermal conductivity and they tend to become brittle under heat stress. For most of the high temperature furnaces now in use the components are made of graphite.

Because these furnaces must operate at such high temperatures, they require an unusually long time to cool down to a temperature where they can be serviced. For example, it can take as long as 125 hours to cool down a typical carbon-insulated furnace that operates at 2200° C.

Equipment now available for cooling high temperature furnaces leaves much to be desired. On of the known devices consists of lengths of metal tubing joined together to form a cooling "loop". The loop is installed in a fixed location inside the insulation section of the furnace. A cooling fluid (gas or liquid) is circulated through the tubing and the absorbed heat is passed to the atmosphere through a cooling tower, or other means. The cooled fluid is then recycled back through the tubing loop in a continuous operation.

One of the problems with this cooling device is that the metal tubing can't tolerate temperatures above about 800° C., because it will carburize or oxidize. Another problem is that the tubing loop must remain in a fixed location, so that it is constantly exposed to the high temperature environment. These limitations make it necessary to place the tubing loop at a location fairly remote from the hot zone of the furnace, so that the cooling effect it has is quite marginal.

SUMMARY OF THE INVENTION

The invention is a device and method for cooling a high temperature furnace. The furnace includes an insulation section and a hot zone. The insulation section is defined by a space between an outer shell and the roof member. The space is filled with an insulating material, such as lampblack. Below the roof member is a floor member, and the space between these members defines the hot zone of the furnace. The hot zone is heated by heater means positioned inside the insulation section and in contact with the roof member.

In one embodiment of the invention, means for cooling the furnace is provided by probe devices, working in combination with guide tube members. Each guide tube member has a central bore therein and is open at both ends. The central bore is filled with an insulation material and the guide tube extends through the outer shell of the furnace into the insulation section, where it stands in an upright position. A frangible disk is positioned above the upper end of the tube member. Each probe device is defined by two elongate tubular members. The first member has an open upper end and the lower end is closed and tapered. The second member has open upper and lower ends and it is positioned lengthwise inside the first member, with an annulus being defined between these members.

The probe device also includes a knob member with a gas inlet passage therein, and a fitting is fastened to the knob member, which has a gas outlet passage therein. The upper end of the second tubular member is in communication with the gas inlet passage, and the annulus and the upper end of the first tubular member are in communication with the gas outlet passage. Another part of the probe device is a sleeve and a seal assembly, which are positioned above the frangible disk, and the tubular members of the probe device are slidable inside the sleeve and seal assembly.

In a typical cooling operation, a gas stream is directed into the gas inlet passage, so that the gas flows through this passage, the second tubular member, the annulus between the tubular members, and is discharged through the gas outlet passage. Once the gas flow is started, the tapered lower end of the probe device is moved against the frangible disk, to rupture the disk. After piercing the disk, the probe device is moved downwardly through the bore of the guide tube to a stop position, in which the lower end of the probe device is just above the roof member of the furnace. The gas flow is continued until the temperature of the furnace is brough down to a desired level. At this point, the probe device is pulled out of the guide tube.

DESCRIPTION OF THE INVENTION

Figure 1:
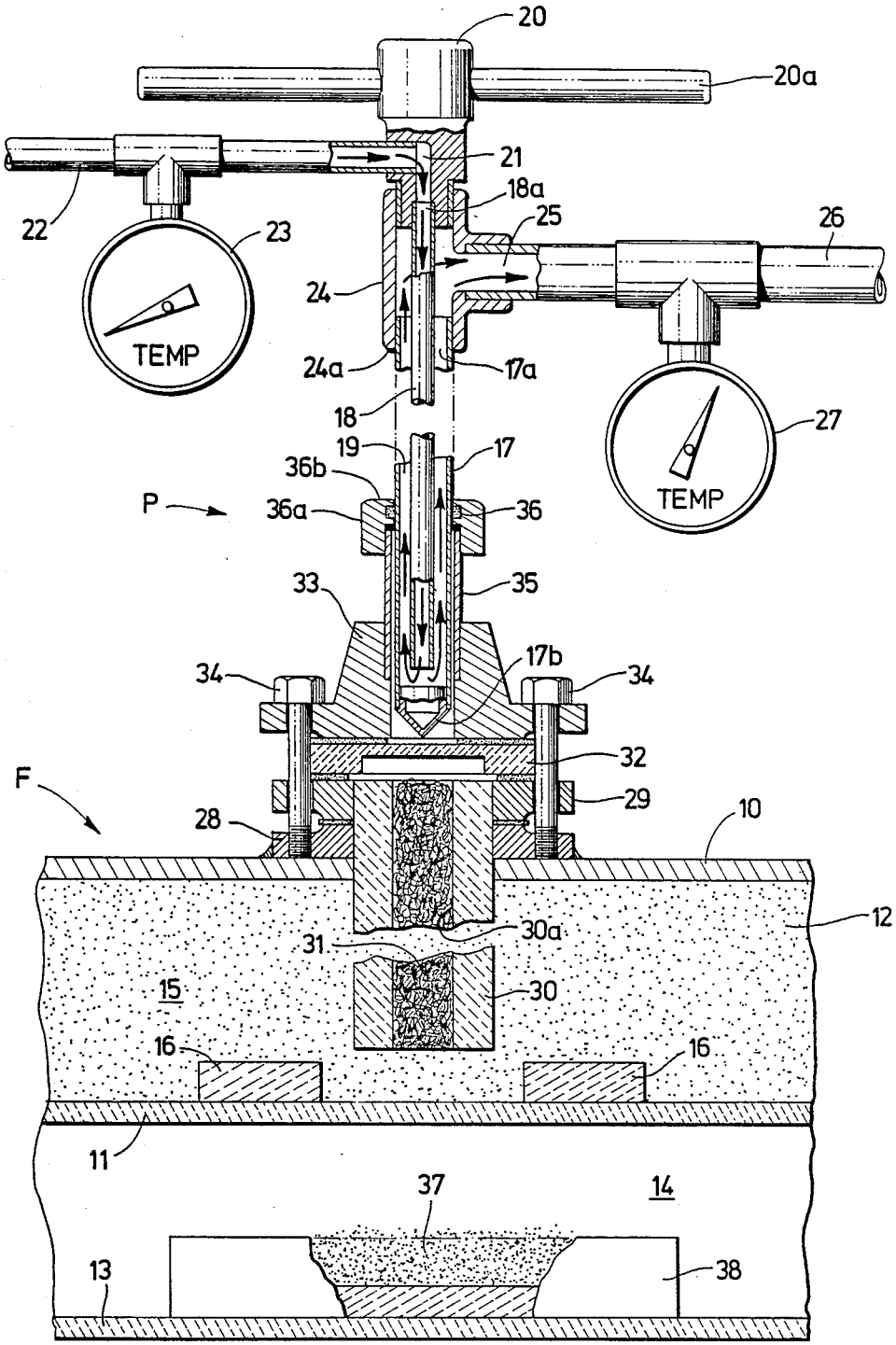
FIG. 1 is a front elevation view, mostly in section, of part of the insulation section and hot zone of a high temperature furnace and the probe cooling device of this invention. In this figure, the probe is shown in its normal position prior to the cooling operation.

In the drawing, referring particularly to FIG. 1, the cooling down probe device of this invention is generally indicated by the letter P. The letter F refers generally to the high temperature furnace which the probe is used to cool. The outside of the furnace is defined by a metal outer shell 10, and spaced below the shell is a roof member 11. The space between the shell and the roof member provides an insulation section 12. Below the roof member is a floor member 13, and the space between these members define the hot zone 14 of the furnace. The roof and floor members are constructed of graphite.

In the furnace F illustrated herein the insulation section 12 is filled with lampblack 15. The type of insulation used in a high temperature furnace depends mostly on the temperature range at which the furnace will be operating. Heater boards 16, which are fabricated of graphite, are positioned on the top side of the roof member 11. A DC current is passed through each board as the heating medium.

An elongate tubular member 17 forms the outer part of the cooling probe P. This member is open at the top end 17a, and the lower end is closed with a tapered fitting 17b, that provides a penetrator tip. This tip fitting is constructed of a nickel-base metal alloy sold under the name HASTELLOY. A tubular member 18, of smaller diameter, fits lengthwise inside the member 17, such that an annulus 19 is defined between the members. The top end 18*a* of member 18 is open and it is fastened into a knob 20, such that is communicates with a gas inlet passage 21. A rod 20*a* is fastened to the knob 20, for convenience in moving the probe device. Gas is directed into passage 21 through an inlet line 22, and a temperature gauge 23 is installed in this line to monitor the temperature of the incoming gas. Line 22 is fabricated of a flexible material to allow it to move downwardly with the probe device during the cooling operation.

A tee fitting 24 is fastened to the knob 20 on one side and the top end 17*a* of tubular member 17 fastens into the opposite side of the tee fitting. The branch pat of the fitting 24 defines a gas outlet passage 25, with the gas being directed through an outlet line 26. Installed in line 26 is a temperature gauge 27, for monitoring the temperature of the outgoing gas. Line 26 is fabricated of the same kind of flexible material as line 22, so that it can move downwardly with the probe device during the cooling operation. A flange 28 is fastened to the top side of shell 10, and a second flange 29 seats down onto flange 28, with a gasket providing a seal between the flanges. The top end of an upstanding guide tube 30 is fastened into the flanges 28 and 29, and the tube extends through roof 10 and down into the insulation section 12.

A central bore 30*a* runs lengthwise through tube 30, and the bore is filled with a ceramic fiber material 31. A suitable material for this purpose is KAOWOOL alumina-silica ceramic fiber. A frangible disk 32 seats over the top end of the guide tube 30, and the disk is held in place by a hold-down flange 33, which is fastened to flanges 28 and 29 by bolts 34. Gaskets (not numbered) between the disk and tube 30, and between the disk and flange 33 provide a fluid seal means. A vertical guide sleeve 35 is fastened into flange 33 and a packing gland 36 and gland nut 36*a* fit over the top of the sleeve to provide a seal assembly.

OPERATION

Figure 2:
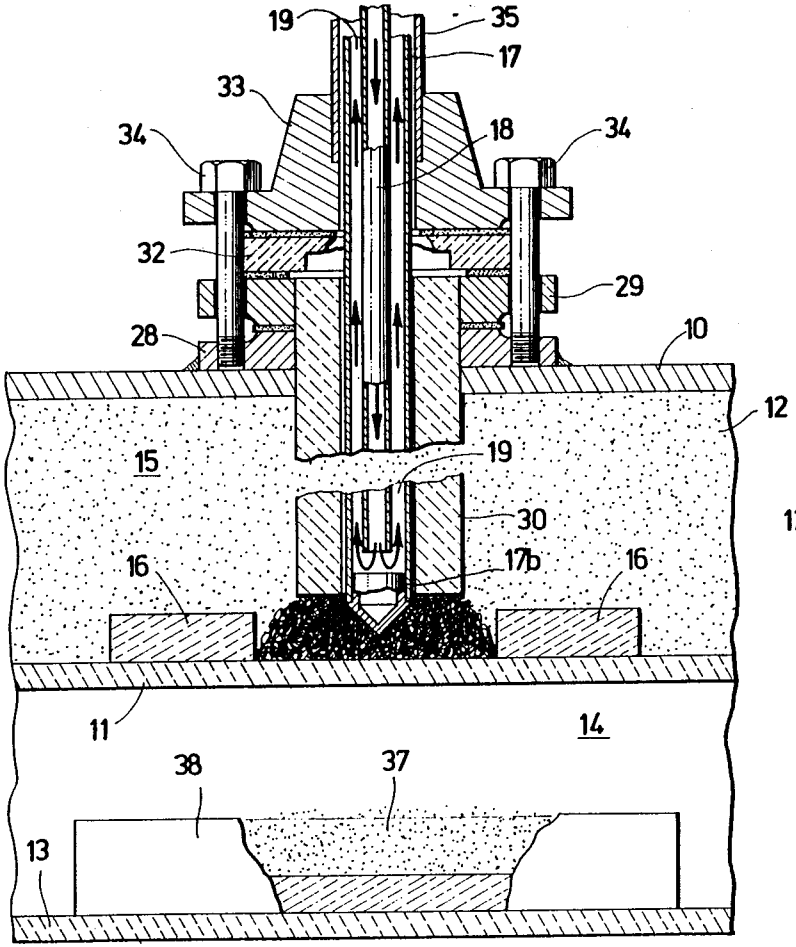
FIG. 2 is a fragmentary view, mostly in section, of the furnace and probe device shown in FIG. 1. In this figure the probe device has been inserted into a guide tube in the insulation section, which is its normal position for the cooling operation.

The practice of this invention can be illustrated by describing a typical operation of the probe cooling device shown in FIGS. 1 and 2. In this operation, the furnace F is being used to make boron carbide 37, which moves through the hot zone 14 of the furnace in a train of product boats 38. To start the operation, a stream of argon gas is carried into the inlet line 22 from a storage tank (not shown). Other inert gases, such as neon or helium, could also be used. From line 22, the gas stream flows downwardly through the tubular member 18 into the annulus 19. The stream moves upwardly through the annulus 19 into the outlet passage 25 and is discharged through outlet line 26.

Once the gas flow is started, the probe device P is pushed downwardly with enough force for the penetrator tip 17*b* to rupture the frangible disk 32. After breaking through the disk, the probe is moved down through the bore 30*a* of the tube 30 until the bottom edge 24*a* of tee fitting 24 seats down against the top surface of gland nut 36*a*. The gland nut thus acts as a mechanical stop to position the tip 17*b* of the probe device at a desired point above the hot zone 14. As shown in FIG. 2, the tip 17*b* is positioned just above the roof 11 of the hot zone, which allows the cooling gas to remove heat at the point in the furnace which is closest to the hot zone 14.

In its downward travel through the guide tube 30, the penetrator tip compresses the ceramic fiber insulation 31 and pushed it out into the insulation section 12, as illustrated in FIG. 2. The purpose of the insulation material 31 is to prevent heat loss through the guide tube 30 while the furnace is in its operating cycle. Once the insulation material 31 is compressed by the penetrator tip 17*b*, it becomes a good conductor for carrying heat to the coolest part of the probe device. During the cooling step, the temperature gauges 23 and 27 enable the operator to constantly monitor the temperature of the gas entering the inlet line 22 and being discharged through the outlet line 26. The gas entering the probe device through line 22 will be at ambient temperature. As the gas exits through the outlet line 26, its temperature will depend on the furnace temperature in the vicinity of the cooling probe, the gas flow rate, and the rate at which heat can be conducted through the furnace insulation and probe material.

When the temperature of the gas leaving through outlet line 26 is not more than about 50° C. higher than the temperature of the gas entering through inlet line 22, the cooling procedure can be terminated. At this point, the temperature of the furnace hot zone, as measured by a pyrometer or thermocouple (not shown), will be about 200° C., or less.

In the practice of this invention, several of the probe devices are used during each cooling period. The actual number used will depend on several factors, such as the size of the furnace, the highest operating temperature, how quickly it is desired to cool the furnace, and the like. After the furnace has cooled, the guide tubes 30 and the broken disks 32 of each probe device are removed. Before the furnace is reheated, the guide tubes are filled with a new charge of the ceramic fiber material and set in place in the insulation section 12, and new frangible disks 32 are set in place in each probe device.

Figure 3:
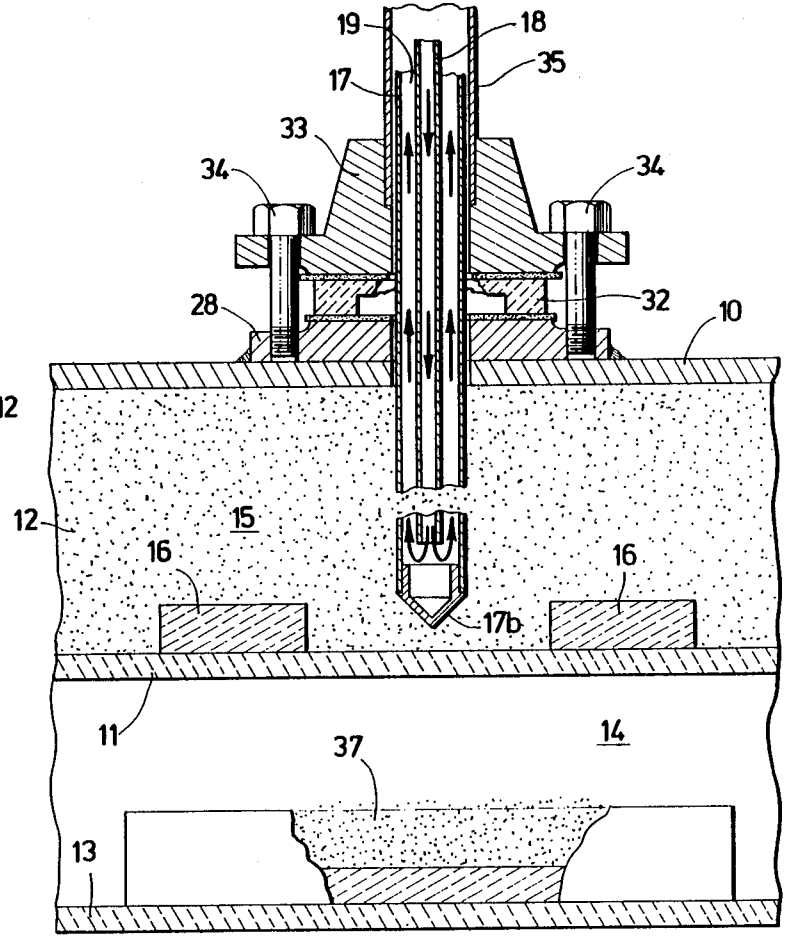
FIG. 3 is a fragmentary view, mostly in section, of a second embodiment of the probe cooling device of this invention. In this figure the probe device has been inserted into the insulation section of the furnace, for the cooling operation, without the use of a guide tube.

A second embodiment of the probe device P is illustrated in FIG. 3. In this embodiment the parts of the probe device are identical to those in the device shown in FIGS. 1 and 2, and therefore the same reference numerals are used to identify the parts. In the embodiment of FIG. 3, the guide tube 30 is not used. In the operation of this device, therefore, the penetrator tip 17*b* pushes aside the lampblack material 15 as the probe moved downwardly into the insulation section 12.

The furnace described above is insulated with a carbon-based material, such as lampblack. The cooling device of this invention can also be used with other high temperature furnaces insulated with non-carbon materials, such as spun alumina, spun ceramics, or loose fill ceramic materials. Inert gases such as argon, neon, helium, or nitrogen, can be used as the cooling medium in a non-carbon insulated furnace.

The invention claimed is:

1. In combination, a high temperature furnace and a device for cooling the furnace, the combination comprising:

an insulation section in the furnace, the insulation section being defined by an outer shell, a roof member spaced from the outer shell, and an insulation material which fills said space;

heater means positioned inside the insulation section and in contact with the roof member;

a floor member which is spaced from the roof member, said space defining a hot zone inside the furnace;

an upstanding guide tube member having an open upper end, an open lower end, and a central bore therein, the central bore being filled with an insulation material, and the tube member extending through the outer shell into the insulation section;

a frangible disk positioned above the upper end of the tube member;

a probe device defined by a first elongate tubular member having an open upper end and a closed and tapered lower end, a second elongate tubular member having an open upper end and open lower end, the second tubular member being positioned lengthwise inside the first tubular member, and an annulus being defined between the first and second tubular members;

the probe device including a knob member having a gas inlet passage therein, and a first fitting member fastened to the knob member and having a gas outlet passage therein;

the upper end of the second tubular member being in communication with the gas inlet passage, the annulus and the upper end of the first elongate tubular member being in communication with the gas outlet passage;

the probe device including a sleeve and a seal assembly that fastens to an upper end of the sleeve, the sleeve and the seal assembly being positioned above the frangible disk, and the first and second tubular members being slidable inside the sleeve and the seal assembly;

wherein, in operation, a gas stream is directed into the gas inlet passage, so that the gas flows through the gas inlet passage, the second tubular member, the annulus between the first and second tubular members, and is discharged through the gas outlet passage;

the lower end of the first tubular member is moved against the frangible disk to rupture the disk, and the probe device is moved downwardly through the bore of the guide tube to a stop position in which the lower end of the first tubular member is just above the roof member;

the gas flow is continued until the difference in the temperature of the gas entering the gas inlet passage, and the gas being discharged through the gas outlet passage, is not more than about 50° C.; and the probe device is pulled out of the guide tube.

2. The combination of claim 1 in which the sleeve member has upper and lower ends, the lower end of the sleeve is fastened into a second fitting member, the seal assembly includes a gland nut that fits over the upper end of the sleeve, the first fitting member has a lower end adapted for seating down against an upper surface of the gland nut when the probe device is moved to its stop position.

3. The combination of claim 1 in which the guide tube is constructed of graphite, and the bore in this tube is filled with a ceramic fiber material 4. The combination of claim 1 in which the insulation section of the furnace is filled with a carbonaceous material.

5. The combination of claim 1 in which the heater means is defined by board-shaped members constructed of graphite and heated by electrical means.

6. The combination of claim 1 in which a rod member is fastened into the knob member in a position crosswise to the knob member, to provide a handle for moving the probe device.

7. In combination, a high temperature furnace and a device for cooling the furnace, the combination comprising:

an insulation section in the furnace, the insulation section being defined by an outer shell having a top surface, a roof member spaced from the outer shell, and an insulation material which fills said shape;

heater means positioned inside the insulation section and in contact with the roof member;

a floor member which is spaced from the roof member, said space defining a hot zone inside the furnace;

a first fitting having a top surface, said fitting being fastened to the top surface of the outer shell, and having a bushing therein that extends through the outer shell;

a frangible disk that seats on the top surface of the first fitting;

a probe device defined by a first elongate tubular member having an open upper end and a closed and tapered lower end, a second elongate tubular member having an open upper end and open lower end, the second tubular member being positioned lengthwise inside the first tubular member, and an annulus being defined between the first and second tubular members;

the probe device including a knob member having a gas inlet passage therein, and a second fitting member fastened to the knob member and having a gas outlet passage therein;

the upper end of the second tubular member being in communication with the gas inlet passage, the annulus and the upper end of the first elongate tubular member being in communication with the gas outlet passage;

the probe device including a sleeve member and a seal assembly that fastens to an upper end of the sleeve member, the sleeve member and sealing assembly being positioned above the frangible disk, and the first and second tubular members being slidable inside the sleeve member and the seal assembly;

wherein, in operation, a gas stream is directed into the probe device, so that it flows through the gas inlet passage, the second tubular member, the annulus between the first and second tubular members, and is discharged through the gas outlet passage;

the lower end of the first tube member is moved against the frangible disk to rupture the disk, and the probe device is moved downwardly through the bushing and the insulation section to a stop position in which the lower end of the first tubular member is just above the roof member;

the gas flow is continued until the temperature of the gasing entering the gas inlet passage is about equal to the temperature of the gas being discharged through the gas outlet passage; and the probe device is pulled out of the insulation section.

8. A method for cooling a high temperature furnace, the furnace including an insulation section defined by an outer shell having a top surface, a roof member spaced from the outer shell, and an insulation material that fills said space, the furnace including a floor member spaced from the roof member, the space between said members defining a hot zone, the furnace including a heater means positioned inside the insulation section and in contact with the roof member, the method comprising the steps of:

fastening a fitting to the top surface of the outer shell, the fitting having a top surface and a bushing therein that extends through the outer shell;

positioning a frangible disk on the top surface of the fitting;

positioning a probe device above the frangible disk, the probe device including a first tubular member having an open upper end and a closed and tapered lower end, a second tubular member having open upper and lower ends, the second tubular member being positioned lengthwise inside the first tubular member, and an annulus being defined between the first and second tubular members;

including in the probe device a gas inlet passage in communication with the second tubular member, a gas outlet passage in communication with the first tubular member, and a sleeve and a seal assembly, the sleeve and the seal assembly being positioned above the frangible disk, and the first and second tubular members being slidable inside the sleeve and the seal assembly;

directing a stream of gas into the gas inlet passage, and flowing the gas through the second tubular member, the annulus between the first and second tubular members, and discharging the gas through the gas outlet passage;

moving the lower end of the first tubular member against the frangible disk to rupture the disk, and moving the probe device downwardly through the bushing and the insulation section to a stop position in which the lower end of the first tubular member is just above the roof member;

continuing the gas flow until the temperature of the gas entering the gas inlet passage is about equal to the temperature of the gas being discharged through the gas outlet passage; and pulling the probe device out of the insulation section.

* * * * *